US010939516B2

(12) United States Patent
Barrett

(10) Patent No.: US 10,939,516 B2
(45) Date of Patent: Mar. 2, 2021

(54) DEVICE, METHOD, AND SYSTEM FOR CREATING DYNAMIC HORIZON EFFECT LIGHTING

(71) Applicant: Gregory Barrett, Sheboygan, WI (US)

(72) Inventor: Gregory Barrett, Sheboygan, WI (US)

( * ) Notice: Subject to any disclaimer, the term of this patent is extended or adjusted under 35 U.S.C. 154(b) by 0 days.

(21) Appl. No.: 16/780,265

(22) Filed: Feb. 3, 2020

(65) Prior Publication Data

US 2020/0281055 A1 Sep. 3, 2020

Related U.S. Application Data

(60) Provisional application No. 62/919,148, filed on Mar. 1, 2019.

(51) Int. Cl.
*H05B 45/10* (2020.01)
*H05B 47/19* (2020.01)

(52) U.S. Cl.
CPC ..... *H05B 45/10* (2020.01); *H05B 47/19* (2020.01)

(58) Field of Classification Search
CPC ..... H05B 45/10; H05B 47/19
USPC ..... 315/291
See application file for complete search history.

(56) References Cited

U.S. PATENT DOCUMENTS 7,586,271 B2 * 9/2009 Shuy ..... G09G 3/3406 315/291
10,039,175 B1 * 7/2018 Thornton ..... H05B 47/16
2003/0057886 A1 * 3/2003 Lys ..... F21S 4/10 315/291
2005/0070760 A1 * 3/2005 Hillis ..... H05B 47/18 600/109
2005/0111231 A1 * 5/2005 Crodian ..... H05B 45/00 362/545
2008/0224026 A1 * 9/2008 Pasternak ..... H05B 47/19 250/206
2009/0051523 A1 * 2/2009 Perkins ..... B60Q 1/44 340/478
2012/0038490 A1 * 2/2012 Verfuerth ..... G08G 1/056 340/910
2012/0050606 A1 * 3/2012 Debevec ..... G03B 15/07 348/370
2012/0200229 A1 * 8/2012 Kunst ..... H05B 45/3577 315/186
2013/0119891 A1 * 5/2013 Herremans ..... H05B 47/16 315/293
2015/0137696 A1 * 5/2015 Moon ..... H05B 45/44 315/250
2017/0347436 A1 * 11/2017 Hirowatari ..... H05B 47/19

* cited by examiner

*Primary Examiner* — Don P Le
(74) *Attorney, Agent, or Firm* — Mandy L. Tran; Ceres Patent & Technology, LLC

(57) ABSTRACT

An inventive solution directed to an apparatus and system for creating a dynamic ambient lighting experience wherein the level of brightness increases and decreases along a horizonal path to create an impression of linear movement. This simulates the traversal of the sun along its horizon. The device comprising subsection units which may be coordinated to increase or decrease length. The time and speed for dimming and brightening of light from start to finish along the length of the device may be defined by preconfigured parameters or customized to desired setting. The device creating a diurnal pattern of light transition and movement along the length of an indoor space subject to the peripheral view of the observer.

8 Claims, 2 Drawing Sheets

MS: MOVEMENT START RU: RAMP UP
ME: MOVEMENT END RD: RAMP DOWN

DEVICE, METHOD, AND SYSTEM FOR CREATING DYNAMIC HORIZON EFFECT LIGHTING

CROSS REFERENCE TO RELATED APPLICATIONS

This nonprovisional utility patent application incorporates by reference in its entirety and claims benefit to provisional patent application No. 62/919,148, having the filing date of Mar. 1, 2019, pursuant to 35 U.S.C. § 119(e).

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark office, patent file or records, but otherwise reserves all copyright rights whatsoever.

BACKGROUND OF INVENTION

Field of the Invention

The present inventive subject matter relates to a method, device, and system for indoor lighting that achieves a dynamic transitional affect in variable manner.

Background

Visible light has always been part of the human experience. The sun rises, fall, and is bright in the middle of the day. Much has been said about the intensity and color of light and its effect on our physiology and mood. However, less has been noted about how the position of the sun on the horizon affects us. The sun's rise and fall provides a consistent rhythm. This rhythm is both informative and comforting.

Between its phases of rise and fall, perception of the sun's position relative to the visual horizon at any given moment will depend on a variety of factors. These factors comprise without limitations the following: longitudinal and latitudinal position of the viewer, the axial position of the earth, the relevant astronomical season, the time of day, the orbital position of the earth relative to the sun, etc. These factors have determinative effect on the viewer's perception of the sun's light intensity, its angular position and its duration above the horizon.

In speaking to the movement of the sun relative to the visible horizon, the sun will rise above the Eastern horizon and set at the Western horizon. The intensity and brightness of sunlight will change according to its angle of elevation above the visible horizon. The duration of time in which the sun may remain at a certain angle above the horizon would depend on geo-positional location and the given astronomical season. Consider an arbitrary location on Earth. If one is to face north exactly (towards the celestial north pole where the star Polaris resides), East will be to the right and West will be to the left. Proceed then to draw a circle which passes through East and West whose plane is exactly perpendicular to the line joining the viewer and Polaris. This circle marks the path of the sun from dawn to dusk on the two equinoxes (the two times of year when the plane of the Earth's equator passes through the center of the sun). Proceed then to draw a circle which is exactly parallel to the first circle, but which is separated from the first circle by 23.5 degrees (the degree of the earth's tilt along its axis of rotation with respect to the orbital plane) at the zenith towards Polaris. The place where this circle cuts the horizon will mark the place where the sun will rise and set on the day of the summer solstice. A similar circle which is separated from the first circle by 23.5 degrees at zenith towards south will mark the path of the sun on the winter solstice. Beyond the Arctic circle, there will be some time of the year where the sun stays in the horizon for all 24 hours. Thus, the path of the sun and its duration over the horizon will vary depending on the given geo-position of the observer as well as the astronomical season of the year.

Generally speaking, without respect to time, location of observation, or season, the intensity or brightness of sunlight is consistent according to its angle of position above or below the horizon (at either East or West ends of the horizon). The level of brightness and intensity are categorized as follows:

Nighttime (below −18° to 0°)
Morning twilights (from −18° to 0°)
Astronomical Twilight (from −18° to −12°)
Nautical Twilight (from −12° to −6°)
Civil twilight (from −6° to 0°)
Blue hour (from −6° to −4°)
Golden hour (from −4° to 6°)
Daytime (above 6°)
Golden hour (from 6° to −4°)
Blue hour (from −4° to −6°)
Evening twilights (from 0° to −18°)
Civil twilight (from 0° to −6°)
Nautical Twilight (from −6° to −12°)
Astronomical Twilight (from −12° to −18°)
Nighttime (below −18°)

As discussed above, the sun's durational stay within any segment along its path will depend on astronomical and locational factors. The seasonal diurnal pattern of light will vary from location to location, but will be fairly consistent for the given place. As such, living organisms of any location will biologically adapt to the light conditions of their local environment, developing a circadian rhythm of biological self-regulation around that solar cycle.

As with all living things on earth, the human mind and body is conditioned to the visible change of sunlight for the given environment where the observer resides. This conditioning affects the individual's overall health and function. The effect is psychosomatic, wherein visual access to sunlight helps to trigger and maintain the body's rhythmic circadian function and self-regulation. Denial of sunlight and access to its visual cues for any extensive time will have deleterious effect on the body and mind.

Various technology has been developed among the prior art to address needs related to sunlight therapy and circadian health. The prior art ranges between simple static controlled light therapy boxes to technology that mimics the sun's illumination cycle. U.S. Pat. No. 5,589,741 provides a device and system for variable light intensity illumination over a course of time that is predetermined by preconfigured means and controlled by computer device and output. By this method, diurnal sunlight pattern is expressed by timely adjustment of illumination intensity between dimness and brightness of a light source. This disclosed technology focuses diurnal light intensity.

U.S. Pat. No. 9,820,365 also addresses diurnal lighting intensity by dynamic means of adjustment. As with U.S. Pat. Nos. 5,589,741, 9,820,365 similarly addresses change in luminescence to reflect natural diurnal sunlight intensity patterns over a period of time. The technology presented by U.S. Pat. No. 9,820,365 however focuses mainly on facilitation of sleeping and waking cycles. A first lighting element being the main source for continual ambience control which will adjust between phases of light from night time darkness, dawn, daylight, dusk, and again night time darkness. Secondary lighting elements are optional features to this invention and not necessary for its practice. Secondary lighting elements of U.S. Pat. No.'365 comprise general lighting elements for general operational use with typical light intensities for a given functional space and may be subject to the same control unit of the first lighting element during the transitional phases towards or away from darkness. The two-tiered lighting options of U.S. Pat. No.'365 are controlled by a single control unit in tandem manner with the same directional change of luminescence. As such, both U.S. Pat. Nos.'741 and'365 focus on light intensity adjustment.

Yet, another prior art identified as the CREE Cadiant Dynamic Skylight is currently at the edge of introducing a visual sensory experience of out-door light movement. A simulative skylight box (a boxed lighting fixture) positioned within the ceiling of an enclosed room exhibits controlled light movement within the light box fixture to mimic the arc passage of sunlight from East to West. By adjustment of time and intensity, the light within the individual fixture is cast at different angles towards different locations. Multiple ceiling fixtures of this invention may be strategically positioned in the same ceiling space. However, each light box is controlled by the same control unit for tandem adjustment of luminescence over the same course of time and space. As such, the invention fails to create the effect of a true horizontal shift along a greater length of space for more realistic perception by the viewer.

While the existing art has shown to improve human health conditions by adding natural lighting in more dynamic manner within enclosed spaces, the trend continues to focus on lighting options by way of singular fixtures connected to a singular controlling means performing a singular behavior pattern, designed to be perceived in limited manner near the location of the viewer. There remains a considerable need within the industry for inventive solutions that improves upon indoor lighting technology that fully and more realistically simulates diurnal light transition of the sun along its horizonal path. Such technology should provide for improvements beyond mere focus on light intensity, introducing other aspects of circadian health considerations and natural physiological triggers.

Note that all patents and applications referred herein are incorporated by reference in their entirety. Furthermore, where a definition or use of a term in a reference, which is incorporated by reference herein is inconsistent or contrary to the definition of that term provided herein, the definition of that term provided herein applies and the definition of that term in the reference does not apply.

SUMMARY OF THE INVENTION

Technology in the realm of lighting control has evolved substantially since the invention of the incandescent light bulb. Current lighting options in terms of light bulbs for common usage include the traditional incandescent, halogen, fluorescent, CFL (compact fluorescent), and LED (light emitting diodes or alternatively, light emitting device) bulbs. How light is emitted with each of these different sources may vary in substantial ways, but they have a common functional thread. For each of these three types of light sources, a passage of electricity through thin filament causes excitement and heating of the filament resulting in a glow of light. The luminescence of light, its intensity or brightness, is affected by the level of electrical input. With fluorescent light bulbs, passage of electricity through a filament creates heat within the filament, leading to a secondary effect that causes excitement of fluorophore molecules which provides the main source of light. In regards to incandescent bulbs, brightness of light emission is directly proportional to the amount of electrical passage and level of excitement of filament wires. For LED light bulbs, passage of electricity through semi-conductor filament causes movement of electrons, changes in atomic bonds, which results in release of heat and light. At the most basic level, the effect of electricity on the degree of luminescence of these such light sources effectively enables adjustment of light by means of controlling electrical input. The means of controlling adjustment of light may further be digitized. More complex lighting systems require reliable light sources that can sustain longer term usage without intense electrical input that would otherwise create too much heat. LED lighting is the current preferred standard source for lighting given its low electricity demands, quality of light emission, low heat emission, extensive life, and versatile light emission control. For purposes of this invention, LED lighting is the preferred type of light source. However, any of the above described types of light bulbs or any type of light bulbs in general that can achieve the same type of performance described herein may be used.

The invention herein addresses the above identified need within the industry, relating to a device, method, and system for simulating a horizonal diurnal sunlight effect within an indoor environment. The intention of this invention is to bring into an indoor environment an outdoor sunlight transition scheme that may sustain a continual visual trigger to the human body's daily circadian rhythmic needs.

The body responds to light and dark cycles in part through the eye's receipt of light stimulus. The suprachiasmatic nucleus ("SCN") is the primary portion of the brain that regulates the body's circadian rhythmic pattern between a sleep and awake continuum. There are as well portions of the eye retina that functions to receive light stimulus unrelated to image translation, but rather connect to other functional aspects of the brain, forming behavioral and biological adaptation. Melanopsin is in the retinal ganglion cells (ipRGCs) in the eye and projects to the SCN. Melanopsin changes shape in response to blue light. In fact, the action spectra of ipRGCs and melanopsin photopigment peak around 480 nm blue light. Blue light is a high energy light wave. Blue light comprises the shorter segment wave length located between the lower 400-450 nm wave range of the visible light spectrum (just above the ultraviolet light). This light wave is highly stimulating and long exposure to this level of stimulation after evening hours can interfere with sleep. In the natural world with the transition of the sun in its diurnal pathway, blue light will increase towards day light hours and fade into evening night-time hours. This has much to do with its position above the visible horizon. Generally, the regular cycle of natural light stimulation to the body's photoreceptors affect cellular function, particularly with regards to mitochondria activity which produces energy for the body. Excessive exposure to blue light stimulation and in particular to irregular patterns of such exposure may cause serious disruption to bodily functions at a cellular level, leading to physical and mental dysfunction at a macro level. Very recent medical research has revealed that not only is the control of time exposure to certain wave lengths of light important for maintenance of good health, but also the pattern of exposure to light and its regularity.

Prior art within the industry of indoor lighting have failed to adequately address the problem of simulating natural sunlight patterns for optimum experience absorption by the ipRGCs of human retina. While current technology does provide for a controlled timing and exposure to certain light intensities and as well manage the fading transition of light over time, the problem remains that the luminescence of light is produced from a fairly static source and the experience of such lighting effect is relegated to very limited space which does not follow the user as would be the case in an outdoor setting. In a given room where dynamic light (having transition in luminescence) is produced, the effect is typically manipulated within a single light fixture or box. As such, the entire range of sunlight transition is limited within the space of the fixture. While multiple fixtures may be strategically positioned within an indoor space, the lack of coordination between the fixtures as well as their limiting boxed shape detracts from their ability to simulate the natural transition of sun light above an outdoor horizon.

This invention overcomes limitations of the prior art by introducing a device, system, and method for simulating the full range pattern of sun light transition over an outdoor horizon within the length of any given indoor space such that the effect of light transition would be consistently experienced by an observer standing at any location within that space. Therefore, adjustment to light is fluid and uninterrupted within the indoor space by experience of a uniform transition of light over an entire space of any size or shape. By this method, system, and device, the same horizonal affect may be replicated in more than one room location or detached facility such that an individual may experience continuity of the visual triggers throughout the course of their day. For example, the transitional path of light over the simulated horizon (in terms of its speed and angle of placement above the simulated horizon) may be set to be the same at a person's off-site office location and as well in their home such that throughout their day, as they may move between indoor locations, their relationship to the sun remains connected in continuous manner. As such, there would be fewer discord and adjustment to shifting light environments that otherwise would negatively impact an individual's biological circadian rhythm.

The intention of this invention is to provide a consistent and uniform experience within any indoor space of any given shape or size. Further, the indoor simulated effect of the sun's horizonal shift may be in continuity with the true outdoor condition. The resulting effect of this invention therefore creating a fluid experience of sunlight transition and movement between multiple indoor spaces and between indoor and outdoor spaces at any given moment in time.

The invention herein providing a device, method, and system that creates a dynamic ambient light condition simulating the diurnal pattern of the sun traversing above the visible horizon for a given geographical location and for a given astronomical season. The dynamic ambient light condition comprising a simulated horizon where the brightness of light is adjusted along a linear path at a given speed of transition across the entire length or width of a room. Rather than limiting the lighting experience to a designated point of location within a room, this invention addresses the entire room ubiquitously and continuously so that it may be perceived by all of inhabitants within the room no matter their vantage point therein. The light would be perceived from peripheral view by inhabitants within the room as would be the case in an outdoor setting. The invention herein emphasizes the effect of horizonal shift, which here is defined as the ambient effect of the dynamic passage of the sun over its arc above the greater visible horizon for a given geographical location on the planet. The effect of perceived transition of light stimulates both image and non-image related retinal communication to the brain, providing non-image related cues relating to time and space.

The primary purpose and intent of this lighting system is to create ambient light that is able to assist with trigger of non-image related retinal cues over extended time and at a given rate of light transition. The ambient light of this invention comprising a linear path of light cast along the length of an indoor space, preferably either at the ceiling level or the floor level. The system is preferably linear in nature, having a total length as desired to define the simulated horizon. Preferably the system length comprises the total length or substantial length (greater than half the total length or width) of a given enclosed space. The total system length is comprised of smaller interconnected segment units. The entire system, which includes the interconnected segment units, may be contained within a single frame or in multiple separate frames adjacently positioned in interconnected manner to define the entire system length. Each segment unit is capable of expressing different levels of brightness separately and independently from each other at any given time. The particular spread or pattern of dimness or brightness along the entire system length (the simulated horizon within the indoor space) at any given moment provides indication of time of day and season. This light is intended to be perceivable from a person's peripheral vision from any location within the totality of the space as naturally would be the case of a person's peripheral perception of the sun's changing location in an outdoor setting.

In order to enable this system to have uniform and consistent affect among different indoor spaces of different sizes and shapes, the design of the system is key. No matter how long or short the overall system may be, the length of which defines the simulated horizon, the simulated solar path will preferably begin traversal at a first end (preferably the Eastern end) of the room and end at a second end (preferably the Western end) within a defined period of time. Note however that the starting and ending points need not begin from East to West but may be the reverse, although preferably from East to West to simulate the natural path of the sun. The length of each segment unit (which when combined in adjacent manner defines the total length of the system) need not all be the same and may vary in their respective lengths. Preferably the speed of light traversal along a given simulated horizonal path (the total length of the system) is constant between its separate but interconnected segment units. However, given that each indoor facility will likely comprise differing dimensions, the start and end time of the simulated solar path between its first and second ends (between 0 degrees East and 0 degrees West) for any given room is preferably the same no matter the length of the given space. The speed of light movement along the linear path of the simulated horizon may be greater for longer devices and slower for shorter length devices to achieve traversal over the same time span. Therefore, the schedule of light transition along the horizontal path of any given room will be customizable according to the unique dimensions of that room. Customization of transition speed for the particular length of the fixture (according to the dimensions of the room) will enable the total simulated effect to occur within fixed start (sunrise) and end times (sunset). This allows for continuity of experience between separate indoor environments that are set to the same simulated lighting schedule and conditions.

The invention herein providing a new functional relationship which enables the intention and effect of the inventive system, method, and device herein. That function being that the total time for traversal of light (Tt) along the total length of the simulated horizon (the total length of the entire light fixture) (Dt) is the same no matter the length of that fixture. Where Tt is a constant element in this function, and Dt is a known variable, speed of light traversal is the unknown variable that is subject to computerized configuration for each custom installation of this inventive system and device. The speed of light travel therefore being defined by Dt divided by Tt. The interconnected segment units of each entire fixture will be subject to the preconfigured formula for the entire length of system (the overall simulated horizon that is defined as Dt) and subject to that calculated speed of light transition for that system.

Under natural conditions, the level of the sun's illumination above the natural horizon is a function of the sun's angular position above that horizon. The angular transition of the sun's position above the horizon over the course of 24 hours for any given geographical location and astronomical season is known and quantified. The width of an unobstructed natural horizon from the perspective of a human observer standing at ground level is also known, quantifiable, and fairly constant. For purposes of this invention, the width of the natural horizon being defined as the difference in visible length of unobstructed surface space of the earth (from the eye level position of the standing human observer at ground level) between the starting point where the sun first ascends above 0 degree above the horizon (in the East) and the end point where the sun sets at 0 degrees on the same horizon (in the West). This natural horizon as defined herein shares a tangential relationship with the position of the sun at any given moment in time. While over the course of a day, the sun's angular position above the horizon may change, causing a change in the length and width of the sides of this imaginary triangle that touches either ends of the horizonal width, the length of the tangent (the natural horizon) itself will not change. That proportional relationship is maintained in simulated manner with the invented system herein. The total length of the simulated system of this invention (which may vary for any given indoor facility) will serve as the simulated horizon, and thus the tangent in the imaginary triangular relationship with the simulated sun. The triangular relationship of the sun's position above the horizon at any given time is represented in proportional 1:1 scale to the simulated environment where the length of the horizon serves as the tangential constant. The level of brightness of the sun's illumination above the natural horizon is known and quantified for any given moment in time and for any given geographical location and astronomical season. As such, the level of the sun's brightness at any given moment will be representative of the sun's angular position above the horizon and is relatively constant, known, and quantified. By this invention, the level of illumination (measured in lumens) occurring at the particular location along the simulated horizon of this invention, no matter the length of that simulated horizon, will be proportional to the transition of light intensity over the same period of time across the natural horizon. Such that, no matter the length of simulated horizon, the amount of time it takes for full transit of the simulated solar path and the speed of light transition across each of these varied lengths of simulated horizon will be the same and proportional in 1:1 scale to the naturally occurring event.

For purposes of enabling this invention, the speed and brightness of light transition across the length of the system need not correlate with the sun's activity relative to planet earth. In fact, the geographical location and even planet of reference may be different relative to sun but still relying on known quantified elements in terms of the defined natural horizon, the speed of sunlight transition across the natural horizon, the triangular relationship between the sun and the natural horizon, and the astronomical shifts of the sun's position to the particular geographical location of a planet to affect the nature of the sun's path during a given time of year. In fact, the perspective of the viewer may be shifted above the ground level to an elevated space which may broaden the width of the natural horizon and the triangular relationship of the sun to this newly defined horizon, affecting the transition of brightness and the speed of that transition. The functional relationship between these alternative natural observations may still be simulated by this invention in 1:1 proportional manner as described above, although need not be so to enable this invention and may be at different proportional scale for customized effect and purpose.

Yet further, the invention herein may not be directed to the relationship between the sun and earth but rather be based on a fictitious lighting scenario wherein the transition of light intensity and the speed of that transition can be programmed according to the user's own custom creation. What remains the common feature among the various scenarios presented above is that the system spans the entire length or width of an indoor space, the speed of transition of light intensity follows a particular speed between a first and second end of that system for uniform experience by any observer within that indoor space, and the algorithm for the nature and speed of transition of light intensity is limited to a constant time which is fixed no matter the length of the system to enable uniform light experience in different room environments within a preconfigured time frame.

The device of this system comprising one or more mountable light fixtures having a preferably linear shape that can be horizontally positioned along the length of an indoor surface. The device by its broadest description comprising a frame (F), light emitting modules (Mx-x), their power supplies (PSx), a controller (C) with a control program (CP), and software (SW). The frame holds the light emitting modules in a line and when mounted on a wall or ceiling, positions them to provide the direct or indirect light. The frame, in whole or in part, dissipates heat from the lighting modules and power supplies. The modules are the units that produce light and are powered by their each separate power supply. Each power supply and module combination has the ability to change luminance independently from the other modules. The power supply and module combinations can change luminance in enough steps to provide a continuous dimming effect.

The controller is processor based and runs the control program (CP), containing the electronic hardware needed to produce the dimming signals. It is not required to be mounted within the frame. The controller running the control program provides dimming signals to individual power supply and module combinations. The parameters in the control program can be changed to customize the action of the system. Changes to the control program are made through user interface software (SW). The software sets the control program parameters.

The software allows the configuration and behavior to be customized. Adjustable parameters include the size and luminance of the brightest section, the speed it moves, the luminance of the other sections, and the luminance at other times of the day. The software can be written for any device that can load the control program in the processor.

The operation of this device is described as follows. The frame is mountable horizontally at a height and orientation to provide the desired direct or indirect light. According to a given selection of preconfigured algorithmic option of the software, the system would begin lighting at a first time of day from a first end of the system and complete its lighting cycle as the light transitions towards and terminates at the second end of the system at a second time of day. The transition of light across the length of the system is achieved by adjustment of brightness within each modular subsection of the device. Each subsection module is programed to adjust from low intensity to high intensity and finally downward to low intensity of brightness. The adjustment of brightness of the immediately adjacent module in the forward moving direction will be timed to occur in tandem with the previous module to achieve a desired sum effect of brightness for the given moment in time of the entire program period. For example, in far northern or southern latitudes during bright seasons where it is bright the full day, then each of the modular subsections would begin with the same level of light intensity and maintain it for the full program period. Alternatively, along more central latitudes where the sun rises out of darkness and transitions to a longer period of light and back towards sunset into darkness, each subsection of the system may begin at the same level of intensity in darkness with gradual tandem shift to a base level of sunrise ambience. At which point, the luminance of a modular subsection at the first end (preferably the Eastern end) will begin to increase. At a particular time, luminance of the forwardly adjacent module will also begin to increase while the luminance of the previous adjacent module is maintained. For example, in the middle of the program period, the center modules will be at full brightness while the adjacent modules will be at 60% brightness and the remaining modules will be at 30% luminance. At a later time of day, simulating sunset, the luminance of a greater portion of modules proximate to the first end will begin to decrease. Brightness will shift towards the second end during sunset period by manner of dimming the modules along the first end of the system while moving and concentrating the higher level of brightness towards the second end. At the end of the program period, the brighter section will reach the second end of the entire system device and dim to the same level of the rest of the device such that the entire device will end at the same level of low intensity luminance as it had started with. Each module subsection of the entire system device having the same capacity for minimum and maximum brightness. A range of minimum and maximum lumen capacity is achievable by any of the above listed types of light bulbs, but in this case LED technology is the preferred source for greater ease of control, consistency, and safety. The speed of light adjustment is preferably the same among each adjacent modular subsection, although it need not be and may have variable speeds at different locations within the program period to achieve a custom affect. Since each modular subsection is connected to its own power supply, its brightness may be independently adjustable. Each separate module and their respective power supply will communicate with a central controller, said central controller in communication with a control program ad software. Parameters for the controller may be preconfigured or manually adjustable for customized performance through the control program according to its software. The controller relays the particular preconfigured control program option to the various modular subsections, resulting in a coordinated program experience among the modular units of the system in whole.

In summary, the invention in its preferred embodiment being describable as comprising an apparatus for creating a dynamic ambient lighting affect having variable intensity of brightness over time and at different locations along a linear path. Said apparatus comprising one or more linear frames. Each said one or more linear frames containing one or more subframes. Each said one or more subframes containing one or more lighting elements. Each said one or more subframes in connection with a power source such that said power source provides uniform and tandem output of power to each of said one or more connected subframes. Each said one or more subframes in connection with a power source defining a subsection unit. Said one or more linear frame of said apparatus containing one or more subsection units. Each subsection unit of said linear frame having its own independent and separate power source enabling independent and separate adjustment of illumination between each said one or more subsection unit. Said apparatus further comprising a single controller containing a control program in communication with preconfigured software. Said controller is further in communication with each subsection unit of said one or more subsection unit of said apparatus. Each said subframe of said one or more subframes may have a linear, angular, or rounded shape, or a combination thereof. Each said subframe of said one or more subframes of this invention, each said subsection unit of said one or more subsection unit, and each said linear frame of said one or more linear frames of the apparatus of this invention may comprise the same or different shape, but when positioned in adjacent manner forms a linear path for which light moves in variable manner therein. Said one or more linear frames are positionable in adjacent manner along a linear path with inter-related functionality according to preconfigured software program that is communicated through said controller. Said one or more linear frames having a linear, angular, or rounded shape, or a combination thereof, and positionable in adjacent manner to extend along a visually linear path. Said visual linear path may comprise an end to end adjacent relationship or alternatively, may be adjacently positioned in recessed manner along a given planar space to create a visual perception of linear horizon but with added dimension of depth. Said controller is remotely operable by wireless digital communication means. Said digital communication means may embody a remote or portable digital apparatus connected to a software enabling means that communicates the software program of this invention. Said software enabling means may either be in wireless communication with said software program that is remotely located or alternatively be directly connected to said software program which may be held within said digital communication means.

According to its preferred embodiment, the invention herein further comprising a method of creating a variable and dynamic ambient lighting experience along a linear path wherein the brightness of the light is adjustable at different locations and at different moments in time along said linear path. Said method providing an apparatus as described herein wherein one or more linear frames containing one or more subsection unit is positioned in linear fashion and in communication with a central controller, forming said single apparatus of this invention. Positioning said single apparatus of this invention in linear fashion along a surface. Enabling the transmission of power of each said power source of said single apparatus of this invention. Selecting a lighting pattern and lighting schedule by preconfigured settings or by custom configuration according to parameters of said software program through said control program and controller. Said method alternatively provides for the positioning said single apparatus of this invention in linear fashion along one half or greater than one half of the length or width of a defined space to create a horizon affect. The defined space may comprise an entire indoor space, or a segmented area within a larger indoor space serving specific local purpose within that segmented area. Said defined space may further comprise a semi-enclosed space or alternatively an outdoor space having delineated dimension for a particular use or purpose. Said speed of variable light adjustment along said linear path is determined by dividing the total length of said single apparatus of this invention by the selected time period of lighting pattern or lighting schedule from start to finish of its configured operation.

Other features, advantages, and object of the present invention will become more apparent and be more readily understood from the following detailed description, which should be read in conjunction with the accompanying drawings.

DETAILED DISCRIPTION OF THE PREFERRED EMBODIMENTS

Reference will now be made in detail to exemplary aspects of the present invention which are illustrated in the accompanying drawings. Wherever possible, the same reference numbers will be used throughout the drawings to refer to the same or like parts.

Figure 1:
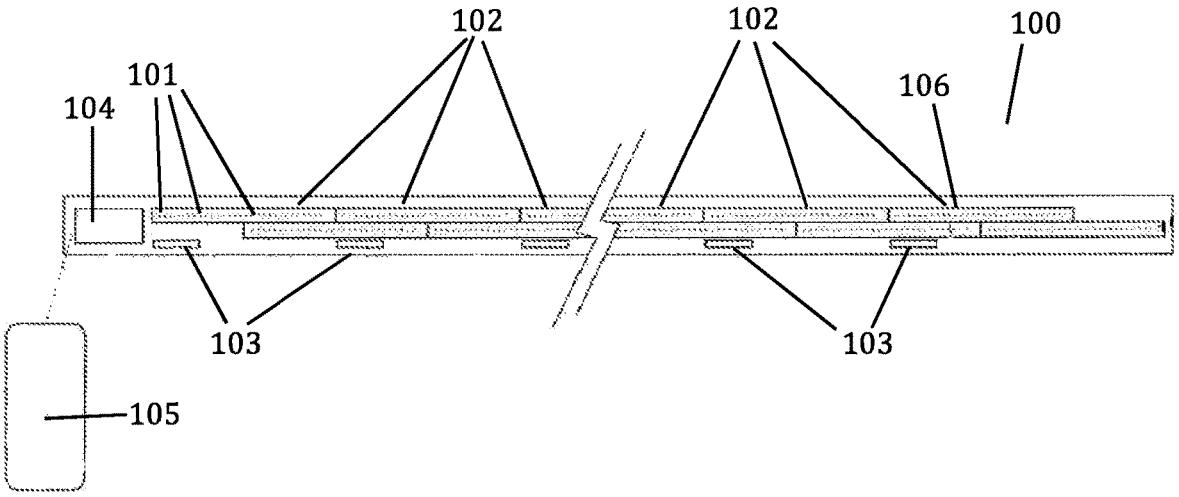
FIG. 1 is a plan front perspective view of the invention according to a first embodiment.
Figure 2:
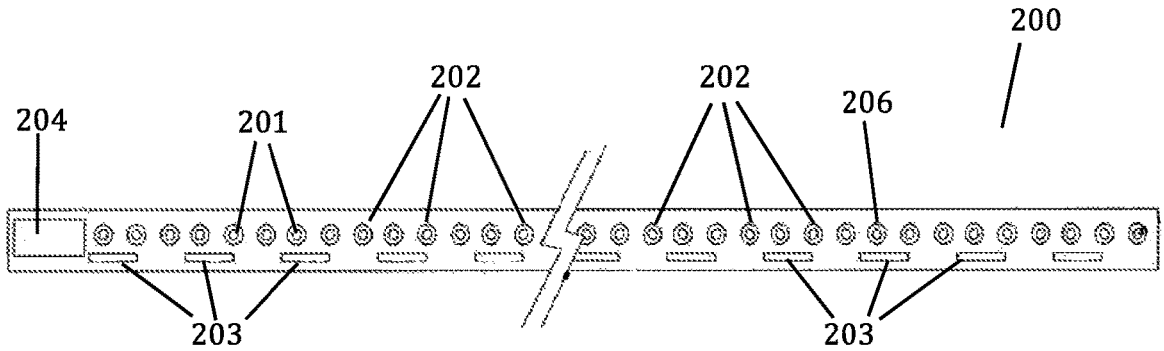
FIG. 2 is a plan front perspective view of the invention according to a second embodiment.
Figure 3:
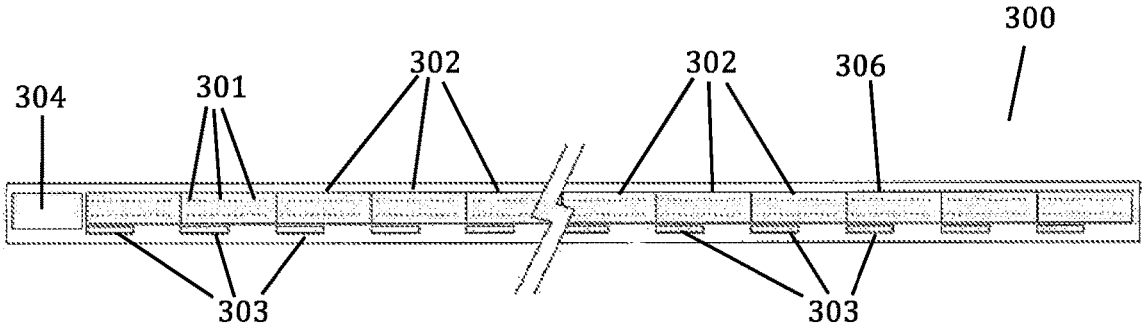
FIG. 3 is a plan front perspective view of the invention according to a third embodiment.

FIGS. 1-3 provides separate embodiments of the device of this invention comprising a length of the system 100, 200, 300. The given length of the system as presented in FIGS. 1-3 containing one or more lighting elements. Said one or more lighting elements 101, 201, 301 contained and organized within a modular unit (also referred herein alternatively as a modular subsection) 102, 202, 302. Each modular unit 102, 202, 302 is in direct communication with a power supply 103, 203, 304. Each modular unit 102, 202, 302 is also in direct communication with a controller 104, 204, 304. Each said controller 104, 204, 304 is in direct communication with a control program 105 which directs operation of the system according to a computer software program 105.

According to the embodiment exemplified in FIG. 1, each modular unit 102, 202, 302 containing a series of lighting elements 101, 201, 301 held within a linear subframe. The lighting elements 101, 201, 301 may comprise any form that can be adjusted in brightness by computer software means 105. Currently the preferred type of lighting element are LED light sources. In this case, the subframe 106, 206, 306 containing sufficient LED lighting elements 105 to enable a desired level of minimum and maximum brightness above the level of complete darkness. The level of brightness preferably is sufficient to create ambient lighting along the length and surface of the location of fixture and yet be visible from any location within the room. Preferably an occupant within the given room may experience the light and recognize its adjustment of brightness over time from any location within the room near the fixture. Each modular unit 102, 202, 302 may contain one or more single light element subframe. Each subframe 106, 206, 306 may be positioned in multiple tiered staggered manner as shown in FIG. 1 or in adjacent manner in FIGS. 2 and 3. FIG. 1 illustrates a single row of lighting elements contained within each subframe 106, 206, 306 and wherein two parallel rows are positioned in staggered manner to achieve a blended lighting affect. FIG. 2 illustrates each subframe 106, 206, 306 to comprise a circular system for more locally directed and amplified affect. FIG. 3 alternative illustrates each subframe 106, 206, 306 to be shorter in length containing two parallel rows of lighting elements 105, 205, 305 achieving a broader and brighter affect. The subframes of this invention may comprise yet other embodiments having different shapes, quantity of lighting elements, and organization of such lighting elements according to the preferred cumulative lighting effect sought to be achieved.

This invention may comprise an alternative embodiment further dividing the length of the system into modular subsections held within their individual modular subsection frames. Each individual modular unit (referenced alternatively and interchangeably as a modular subsection) containing one or more lighting subframes as described above. Each modular subsection is in direct communication with a single control program and functionally managed by the same software configuration. The advantage to the alternative embodiment is that each modular subsection may be positioned adjacently to each other but staggered away from each other slightly for added dimensional lighting affect. Often times, rooms may further have certain off-setting features along its ceiling that cannot accommodate a single linear fixture. Dividing the length of this system into subsections allows for greater adaptation of the simulated horizon of this invention to wide varieties of building designs.

Each modular unit or subsection being essentially defined to comprise one or more lighting subframe containing a plurality of lighting elements arranged in preconfigured manner, and at least one or more energy source communicating with the lighting elements of said one or more lighting subframes. Each modular unit further in communication with a control program and functionally managed and directed by a computer software program. Each energy source controlling brightness of each and all lighting elements that are in communication therewith, which may be one or more lighting subframes in connection with each energy source. It may also be stated that each energy source defines a lighting unit by the number of (at least one or more) lighting subframes connected to or is in communication therewith. Adjustment of energy releases (measured in Watts) by each energy source will proportionally change the level of brightness of each and all lighting subframes connected to or in communication therewith. Such that any number of lighting subframes connected to or in communication with an energy source will be equally and tandemly controlled and adjusted in their respective level of brightness with the same identical resulting affect. Effectively, each lighting unit being autonomously controlled and autonomously functioning independent from the other within the length of this system. For purposes of this invention, each length of system will comprise more than one lighting unit adjacently positioned to another. Each lighting unit is commonly connected to a control program and common software. Each length of system preferably contains a plurality of lighting units and may be held within a single frame or among multiple separate sub-frames. The sequential transition of dimness to brightness and back towards dimness between each adjacently positioned lighting unit will create a visual impression of movement of light along the horizontal length of the system. The quantity and size of each lighting unit and how each are positioned relative to another in adjacent manner will determine the degree of gradual smoothness with which the light transition is visually perceived.

Each modular unit (also referred to as modular subsection) may comprise one or more lighting units. Each modular unit being defined by their singular programmed dynamic affect. Where a modular unit contains a plurality of lighting units, the plurality of lighting units would function in unison for a singular larger scale affect. The modular unit may be redefined for the same device according to preconfigured parameters of the control program and software. For example, for more gradual and subtle effect (and perhaps a slower speed of transition), the modular unit may comprise less quantity of lighting units. While for more dramatic changes or more visually noticeable effect, each modular unit may comprise a greater number of lighting units. The particular quantity of lighting units and the particular grouping of lighting units to form a given modular unit may be changed through the control program and software. These groupings may be pre-configured and pre-programed or otherwise manually adjusted for custom preferences. The ability to redefine and change modular units in terms of the selection of grouping of lighting units and speed of change in illumination allows the system of this invention to be adaptable to different seasonal and geographical sunlight affect or alternatively to artificial and fictitious parameters.

Figure 4:
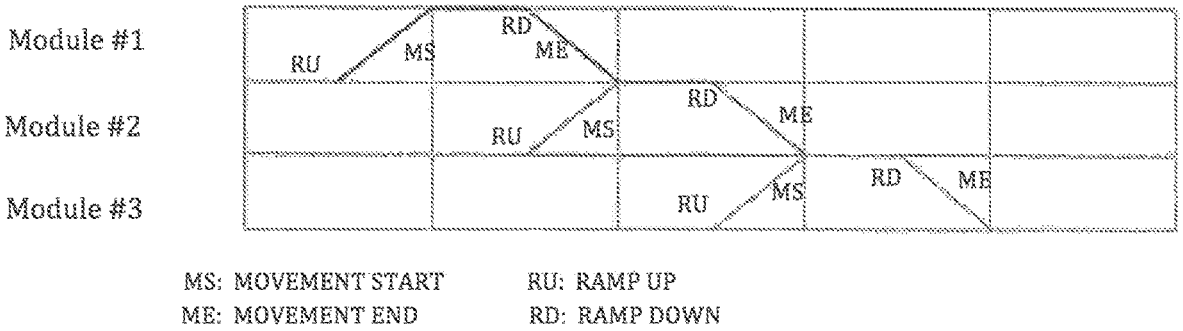
FIG. 4 is a graphical illustration of the method and system according to an embodiment of this invention.

FIG. 4 provides a graphical illustration 401 of a preferred embodiment of this invention showing the coordinated performance effects of three separate modular unit of lights that are adjacently positioned. Module #1 is adjacently positioned to Module #2 and Module #2 is adjacently positioned to Module #3 from left to right. Modular #1 comprising the starting position for light transition. Each modular unit having a unison effect over time. The layered effect between each modular unit providing a blended transition of brightness over time and an illusion of movement of the brighter light from left to right. In this case, the moment when Module #1 transitions out of its brightest phase towards ambient dimness, Modular #2 transitions from ambient dimness towards its highest level of brightness. Similarly, as Modular #2 transitions from its brightest phase towards ambient dimness, Modular #3 transitions from ambient dimness towards its highest level of brightness. Eventually this cascade affect will reach the final modular unit where the light will transition out of brightness into a final ambient dimness, to be at the same ambient level of dimness as all the other modules preceding it.

The choreography of light transition by any given modular unit and between the plurality of modular units of any given length of device may be configured to achieve a preferred dynamic affect. As discussed above, the type of lighting subframe and how each lighting unit is positioned relative to each other will also have an effect on the preferred dynamic affect and would be considered when configuring the choreography of light transition. Multiple subframes each carrying one or more modular units may be centrally controlled according to any selection of pre-configured dynamic light transition affect. Tiered positioning of adjacent subframes away from each other across a horizontal plane may achieve a third dimensional effect of light movement either towards or away from the observer.

Having fully described at least one embodiment of the present invention, other equivalent or alternative methods according to the present invention will be apparent to those skilled in the art. The invention has been described by way of summary, detailed description and illustration. The specific embodiments disclosed in the above drawings are not intended to be limiting. Implementations of the present invention with various different configurations are contemplated as within the scope of the present invention. The invention is thus to cover all modifications, equivalents, and alternatives falling within the spirit and scope of the following claims.

I claim an invention as follows:

1. An apparatus for creating a dynamic ambient lighting affect having variable intensity of brightness over time and at different locations along a linear path, said apparatus comprising:

one or more linear frames, each said one or more linear frames containing one or more subframes, each said one or more subframes containing one or more lighting elements, each said one or more subframes being independently and separately powered by connection to its own separate power source each said power source of each said subframe of said one or more subframes providing uniform output of power to the one or more lighting elements therein, each said one or more subframes defining a subsection lighting unit, the power output from each said power source of each said subsection unit being variably adjustable by communication with a controller, the level of illumination or brightness of said one or more lighting elements within each said subsection lighting unit being variably adjustable or variable by communication of said controller with each said subsection lighting unit, each said one or more linear frames containing one or more of said subsection lighting units, the level of light illumination from each said subsection lighting unit of said one or more of said subsection lighting units within each said linear frame of said one or more linear frames is independently, separately, and tandemly controllable relative to each other.

2. Said apparatus of claim 1 wherein each said subframe of said one or more subframes comprising a linear, angular, or rounded shape, or any combination thereof.

3. Said apparatus of claim 1 wherein said one or more linear frames are positionable in adjacent manner along a linear path with inter-related functionality according to preconfigured software program that is communicated through said controller.

4. Said apparatus of claim 1 wherein said one or more linear frames having a linear, angular, or rounded shape, or any combination thereof, and positionable in adjacent manner to extend along a visually linear path.

5. Said controller of the apparatus of claim 1 is remotely operable by wireless digital communication means.

6. A method of creating a variable and dynamic ambient lighting experience along a linear path wherein the brightness of the light is independently and tandemly variable, said method comprising:

an apparatus according to claim 1 with one or more linear frames, each said one or more linear frames of said apparatus of claim 1 containing one or more subsection lighting units, each said one or more linear frames of claim 1 adjacently positionable to each other in linear fashion, each said subsection lighting unit of said one or more subsection lighting unit of each said one or more linear frames of claim 1 connected to its own separate and independent power source, each said power source in in communication with a controller such that the power output of each said power source is variably adjustable by said controller, whereby positioning each said linear frame of said one more linear frames of claim 1 along a surface in adjacent manner, whereby transmitting electrical power in the form of power output through each said power source, whereby adjusting said power output of each said power source in variable manner separately, independently, and tandemly of each other by a controller, such that said power output of each said power source is variably adjustable by degree of power output, timing of output, and location of output along said linear frame and between each said linear frame of said one or more adjacently positioned linear frames by manner of a software enabled control program that is in communication with said controller.

7. Said method of creating a variable and dynamic ambient lighting experience according to claim 6 wherein said power output of each said power source is variably adjustable by degree of power output, timing of output, and location of output along said linear frame and between each said linear frame of said one or more adjacently positioned linear frames by manner of a software enabled control program that is in communication with said controller, wherein the change to the level of power output within each power source is continual within a redetermined time period and at a predetermined rate of change, wherein said rate of change is is determined by adding the total length of said apparatus, dividing the total length of said apparatus by the predetermined period of time for which light is transmitted through said total length of said apparatus.

8. An apparatus for creating a dynamic ambient lighting affect having variable intensity of brightness over time and at different locations along a linear path, said apparatus comprising:

one or more light fixtures, each said one or more light fixtures comprising a frame and a plurality of light emitting modules, each said light emitting module of said plurality of light emitting modules connected to their each own separate power supply, each said light emitting module of said plurality of light emitting modules in communication with a controller, control program, and enabling software that determines the sequence of illumination effects of each said light emitting module and of said plurality of light emitting modules, the light intensity of each lighting module is controllable and adjustable by communication of the controller with the power supply of the respective lighting module, the level of brightness or illumination of each individual lighting module of said plurality of lighting module are each independently and tandemly adjustable relative to the other by manner of their each separately controllable power supply.

* * * * *